US009475248B1

(12) United States Patent
Russell

(10) Patent No.: US 9,475,248 B1
(45) Date of Patent: Oct. 25, 2016

(54) METHOD OF MANUFACTURING A FLAT BOTTOM POUCH

(71) Applicant: James Russell, Shortsville, NY (US)

(72) Inventor: James Russell, Shortsville, NY (US)

( * ) Notice: Subject to any disclaimer, the term of this patent is extended or adjusted under 35 U.S.C. 154(b) by 0 days.

(21) Appl. No.: 14/885,172

(22) Filed: Oct. 16, 2015

(51) Int. Cl.

| | |
|---|---|
| ***B31B 1/88*** | (2006.01) |
| ***B65D 75/00*** | (2006.01) |
| ***B31B 1/90*** | (2006.01) |
| ***B31B 37/00*** | (2006.01) |

(52) U.S. Cl.
CPC . *B31B 1/88* (2013.01); *B31B 1/90* (2013.01); *B31B 37/00* (2013.01); *B65D 75/008* (2013.01)

(58) Field of Classification Search
CPC ..... B31B 1/88; B31B 1/90; B31B 37/00; B65D 75/008
USPC ..... 493/188, 214, 213
See application file for complete search history.

(56) References Cited

U.S. PATENT DOCUMENTS

| | | | | |
|---|---|---|---|---|
| 4,055,109 | A * | 10/1977 | Kan | B31B 37/00 493/196 |
| 4,954,124 | A * | 9/1990 | Erickson | B29C 65/7437 156/308.4 |
| 5,830,118 | A * | 11/1998 | Nicholson | B31B 37/00 383/104 |
| 6,032,437 | A * | 3/2000 | Bois | B31B 19/90 493/213 |
| 6,293,896 | B1 * | 9/2001 | Buchman | B65B 61/188 493/213 |
| 6,517,660 | B2 * | 2/2003 | Ausnit | B31B 19/90 156/269 |
| 6,539,691 | B2 * | 4/2003 | Beer | B65D 75/46 493/213 |
| D501,134 | S | 1/2005 | Takahashi et al. | |
| D504,622 | S | 5/2005 | Takahashi et al. | |
| 7,156,556 | B2 | 1/2007 | Takahashi et al. | |
| 7,266,934 | B2 * | 9/2007 | Leighton | B31B 19/90 383/63 |
| 7,331,917 | B2 | 2/2008 | Totani | |
| 7,497,624 | B2 | 3/2009 | Totani | |
| 7,775,957 | B2 | 8/2010 | Totani | |
| 8,414,465 | B2 * | 4/2013 | Totani | B31B 37/00 493/162 |
| 8,579,780 | B2 * | 11/2013 | Senbo | B31B 1/64 493/189 |
| 8,616,768 | B2 * | 12/2013 | Inagaki | B31B 19/74 383/120 |
| 2009/0232424 | A1 * | 9/2009 | Bierschenk | B31B 19/36 383/104 |
| 2011/0019943 | A1 * | 1/2011 | Piraneo | B31B 21/00 383/104 |

* cited by examiner

*Primary Examiner* — Sameh Tawfik
(74) *Attorney, Agent, or Firm* — Woods Oviatt Gilman LLP; Dennis B. Danella, Esq.

(57) ABSTRACT

A method of manufacturing a flat bottom pouch from a single continuous sheet of webbing comprises unwinding the continuous sheet of webbing and forming an outwardly extending transverse lap seam. The unwound webbing is asymmetrically folded to form a folded sheet defining front and back panels. The folded sheet defines a first section and a second section having a folded edge therebetween, wherein the first section includes a first distal edge, and wherein the second section includes a second distal edge. The folded edge is pushed between the first and second sections to form a first side gusseted panel. A portion of the second section is folded between the first and second sections to form a second side gusseted panel. A transverse end seal is formed proximate the lap seam thereby defining a bottom gusseted panel and the first edge is sealed to the second edge to complete the pouch.

21 Claims, 7 Drawing Sheets

METHOD OF MANUFACTURING A FLAT BOTTOM POUCH

FIELD OF THE INVENTION

The present invention is directed to a method of manufacturing a flat bottom pouch; and more particularly to a method of manufacturing a flat bottom pouch from a single continuous sheet of webbing; and even more particularly to a method of manufacturing a flat bottom pouch from a single continuous sheet of webbing wherein the pouch has opposing side and bottom gussets.

BACKGROUND OF THE INVENTION

It is well known to use different types of pouches to serve as a container or packaging for many different types of consumer products, as well as food and beverage products. One type of pouch that is used for these types of products is referred to as a flat bottom pouch, wherein the bottom portion of the pouch includes a gusset that allows for the bottom to expand outwardly to provide additional storage space within the pouch. Further, due to its flat bottom, the pouch is capable of standing upright on a support surface.

A flat bottom pouch may typically include front and back panels joined along the sides by opposing gusseted sidewalls and along the bottom by a gusseted bottom panel. This type of pouch is typically manufactured from multiple continuous sheets of webbing, wherein the front and back panels may be fabricated from a single or respective webbings; each side gusset is a separate sheet of webbing; and the bottom gusset may be yet another sheet.

One significant problem with manufacturing the flat bottom pouches using multiple rolls of webbing is that each roll requires its own unwinding mechanics (i.e. rollers, drivers, etc.), thus greatly increasing the cost and complexity of the manufacturing process, as well as requiring a significant amount of floor space within the manufacturing facility. Moreover, multiple mechanisms also require careful monitoring and control of the various mechanical components such that unwinding of the various sheets of webbing is within system tolerances such that the produced pouches meet the desired manufacturing standards.

As such, there is a need for a method for producing a flat bottom pouch formed from a single continuous sheet of webbing. The present invention addresses this and other needs.

BRIEF SUMMARY OF THE INVENTION

One aspect of the present invention is directed to a method of manufacturing a flat bottom pouch including a front panel, a back panel, a first gusseted side panel, a second gusseted side panel, and a bottom gusseted panel formed from a single continuous sheet of webbing. The method comprises unwinding the single continuous sheet of webbing from a roll in a first flow direction. The webbing has a first face and a second face and opposing first and second edges. A transverse lap seam is formed in the unwound webbing with the lap seam extending outwardly from the first face. The unwound webbing is asymmetrically folded along a longitudinal axis of the webbing to form a folded sheet. The folded sheet defines a first section and a second section having a folded edge therebetween, wherein the first section includes a first distal edge, and wherein the second section includes a second distal edge. The folded edge is pushed between the first section and the second section to form the first gusseted side panel having a first side gusset fold. A portion of the second edge that is proximate to the second distal edge is folded between the first section and the second section to form the second gusseted side panel having a second side gusset fold, wherein the first section defines the front panel, and wherein the second section defined the back panel. A transverse end seal is formed proximate the transverse lap seam, wherein the bottom gusseted panel is defined by a length of webbing between the transverse end seal and the transverse lap seam. The first distal edge is sealed to the second distal edge to complete the flat bottom pouch.

In a further aspect of the present invention, the steps forming the first side gusseted panel and second side gusseted panel may be performed sequentially in any order or simultaneously and/or the steps forming the transverse end seal and sealing of the first and second distal edges may be performed sequentially in any order.

In yet a further aspect of the present invention, a width of the first side gusseted panel is substantially equal to a width of the second side gusseted panel and the transverse end seal is spaced apart from the transverse lap seam a distance substantially equal to one-half the width of the first side gusseted panel. One, two or all of the steps of forming a transverse lap seam, forming a transverse end seal and sealing the first distal edge to the second distal edge is conducted using a heat seal and each of steps may be conducted when the webbing is under tension.

In another aspect of the present invention, the method may further comprise the step of cutting the completed pouch from the webbing, wherein the cut is proximate the transverse end seal on a side of the transverse end seal that is opposite to the transverse lap seam. Alternatively, the pouch may be wound onto a roll of flat bottom pouches; and each step may be repeated to form additional flat bottom pouches on the roll.

A further aspect of the invention includes the step of sealing a junction between the first side gusseted panel and the front panel, a junction between the first side gusseted panel and the back panel and a junction between the second side gusseted panel and either the front panel or back panel and opposite the sealed first and second distal edges. One, two or all of the sealed junctions may be formed using a heat seal.

A still further aspect of the present invention may include the additional steps of affixing a resealable closure mechanism to the webbing by unwinding the resealable closure mechanism from a closure roll in a second flow direction; sealing the resealable closure mechanism to the second face of the webbing; and cutting the resealable closure mechanism from the closure roll proximate the first or second distal edge after sealing the resealable closure mechanism. The step of affixing the resealable closure mechanism may occur prior to the step of asymmetrically folding the unwound webbing along a longitudinal axis of the webbing to form a folded sheet. The resealable closure mechanism may be, but is not limited to, hook-and-loop mechanism, a zipper mechanism, a slider, or a zip-lock fastener. Further, the second flow direction is transverse to the first flow direction.

A further aspect of the invention may include the additional step of either cutting the completed pouch from the webbing, wherein the cut is between the transverse end seal of the completed pouch and the resealable closure mechanism of a next successive pouch or cutting the completed pouch from the webbing, wherein the cut is between the resealable closure mechanism of the completed pouch and the transverse end seal of a next successive pouch.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
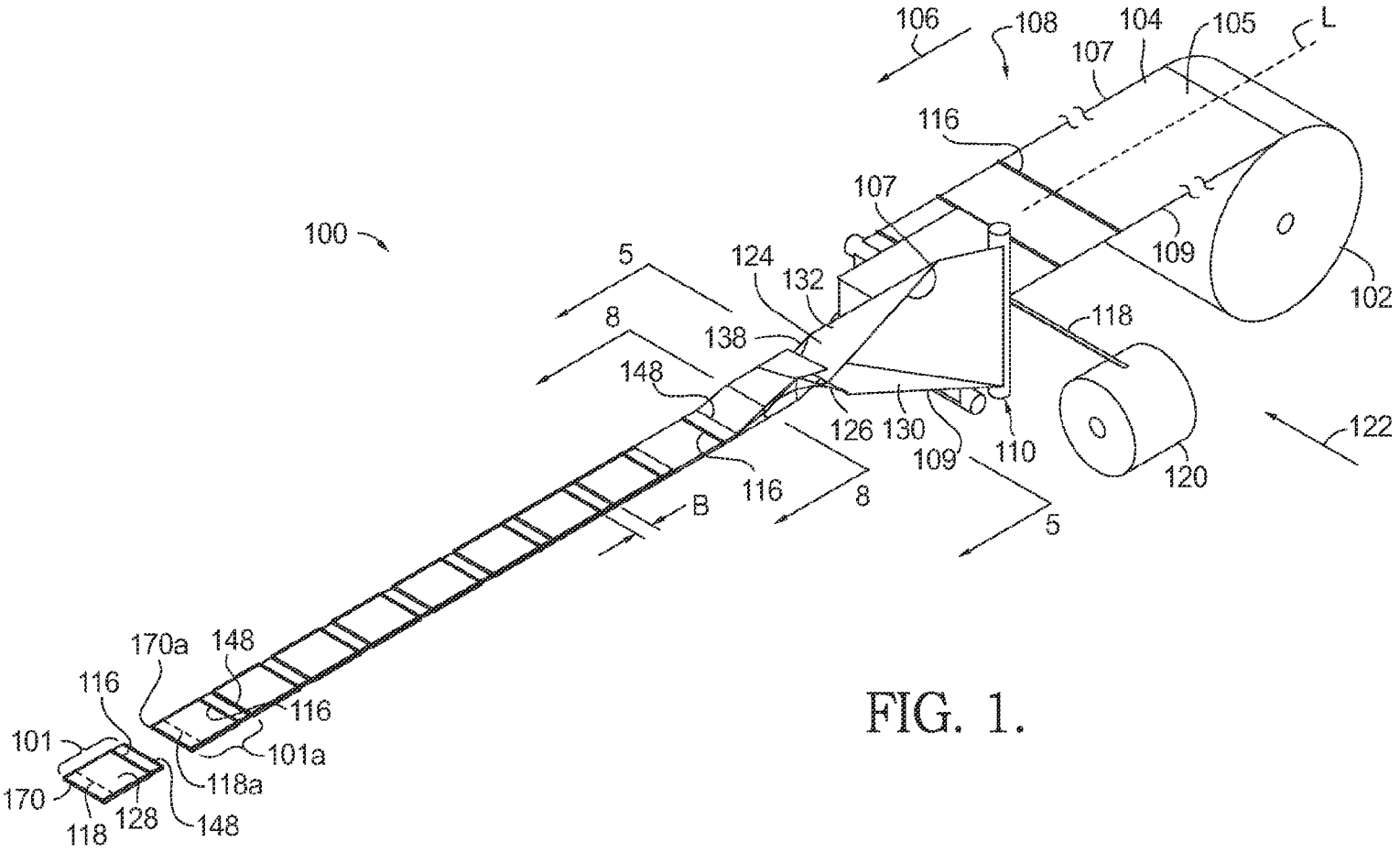
FIG. 1 is a perspective schematic view of a method for manufacturing a flat bottom pouch in accordance with an aspect of the present invention.
Figure 2:
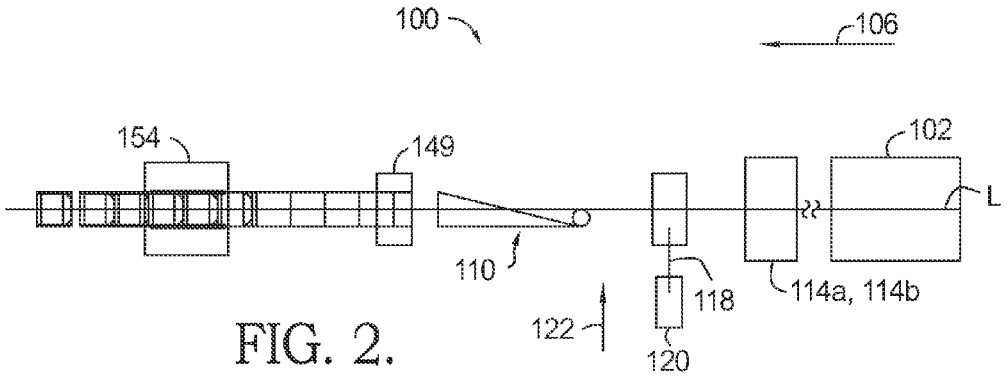
FIG. 2 is a top schematic view of the method shown in FIG. 1.
Figure 3:
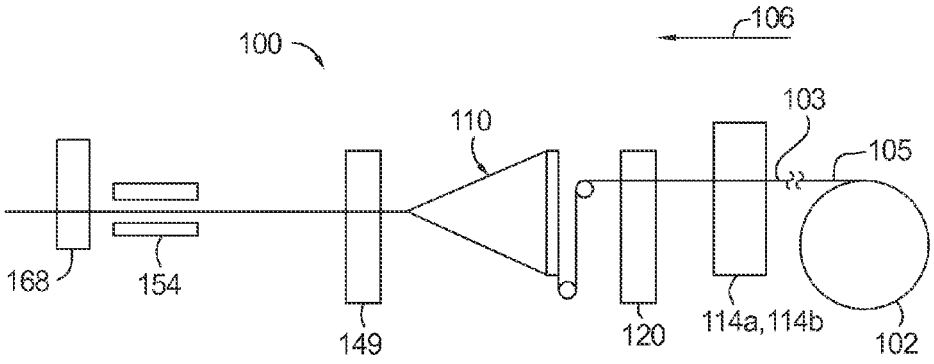
FIG. 3 is a side schematic view of the method shown in FIG. 1.

Referring to the drawings in detail, and specifically to FIGS. 1 through 3, reference numeral 100 generally designates a method of manufacturing a flat bottom pouch 101 (FIGS. 9-11) in accordance with one aspect of the present invention. To initiate method 100, a single continuous roll 102 of pouch webbing 104 is unwound in a first flow direction 106. Pouch webbing 104 includes a first face 103, a second face 105 and opposing first and second distal edges 107, 109. In accordance with an aspect of the present invention, webbing 104 is continuously unwound either by driving roll 102 or by pulling from an auxiliary drive (not shown). Tension on webbing 104 is maintained by speed matching with the unwind drive or braking on roll 102 to counteract the auxiliary drive. Webbing 104 may move into a dancer/accumulator (not shown), as generally known in the art, to provide storage of the unwinding webbing during the intermittent motion required in the next step in the process.

Figure 4:
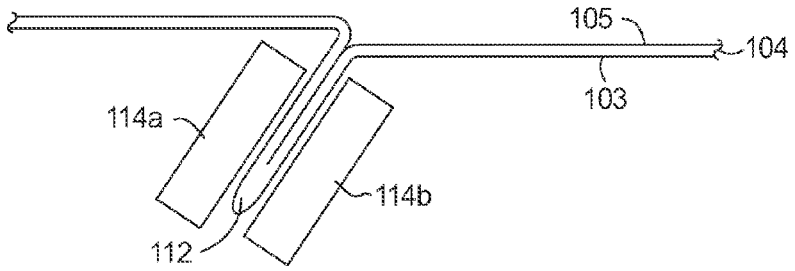
FIG. 4 is a detail representative view of a transverse lap seam produced during the method for manufacturing the flat bottom pouch shown in FIG. 1.

From the dancer/accumulator, webbing 104 enters a "web stop" area 108 that is configured to provide intermittent motion between the continuously unwinding webbing roll 102 and the continuous movement over the turn bar and folding machine 110 which will be discussed in more detail below. When in web stop area 108, forward travel of webbing 104 in direction 106 is temporarily halted for a period of time known as a dwell period such that webbing 104 may be pinched forward over itself to form a pinched web portion 112 (FIG. 4). The dwell period may be any desirable period of time and may be subject to change depending upon the type of materials and the conditions in which the pouches are being formed. Without being specifically limited specifically thereto, the dwell period may be conditioned upon such things as the type or thickness of the webbing used to form the pouch and/or resealable closure mechanism, the overall size of the pouch being formed and the size of pinched web portion 112, as well as environmental factors such as temperature and humidity, for example. As best seen in FIGS. 2-4, a sealer, such as opposing seal plates 114*a*/114*b*, fuses pinched web portion 112 to form a transverse lap seam 116 (FIG. 1). Transverse lap seam 116 may extend outwardly from first face 103 of webbing 104.

Additional processes may be performed during the dwell period. For instance, an optional closure or resealable closure mechanism 118 may be included within completed pouch 101. Examples of such a resealable closure mechanism includes is a hook-and-loop mechanism, a zipper mechanism, a slider, or a zip-lock fastener, although it should be understood that any suitable closure may be employed and such additional resealable closure mechanisms are to be considered within the scope of the present invention. With reference to FIGS. 1 and 2, resealable closure mechanism 118 may be unwound from a closure roll 120, and may be unwound in a second flow direction 122 which is transverse to first flow direction 106. A desired length of resealable closure mechanism 118 is unwound and cut from closure roll 120. Resealable closure mechanism 118 is then affixed to webbing 104, such as, for example, through a heat seal. It should be noted that resealable closure mechanism 118 may be first sealed to webbing 104 prior to becoming cut from closure roll 120 and may be affixed through any suitable means, including a heat seal, an adhesive or any physical fastening such as stitching. Resealable closure mechanism 118 may be affixed to second face 105 such that, upon folding of webbing 104 (as will be discussed in greater detail below), resealable closure mechanism 118 is located on the opposing face to transverse lap seam 116.

At the conclusion of the dwell period, webbing 104 (which now includes transverse lap seam 116 and optional resealable closure mechanism 118) then continues moving in first flow direction 106 where it may encounter web folding machine 110. At web folding machine 110, webbing 104 may be turned vertically and then folded across a V-shaped board so as to become folded along its longitudinal axis L. Webbing 104 is folded such that first face 103 becomes the outer surface 128 of pouch 101, whereby transverse lap seam 116 resides on outer surface 128 and optional resealable closure mechanism 118 resides on inner surface 130.

Figure 5:
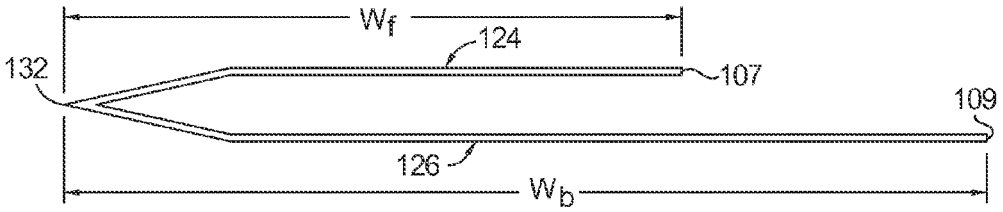
FIG. 5 is a cross-sectional view taken along line 5-5 in FIG. 1 showing an asymmetric webbing fold produced during the method for manufacturing the flat bottom pouch shown in FIG. 1.

As best seen in FIGS. 1 and 5, folded webbing 104 defines a first section 124 and second section 126 with a folded edge 132 disposed therebetween. First section 124 includes first distal edge 107 and second section 126 includes second distal edge 109. Webbing 104 may be asymmetrically folded such that one or the other of first section 124 and second section 126 has an initial greater width, whereby first distal edge 107 does not directly align with second distal edge 109. By way of example, as shown in FIG. 5, first section 124 initially has a shorter width $W_f$ than second section 126 which has an initial width $W_b$.

Figure 6:
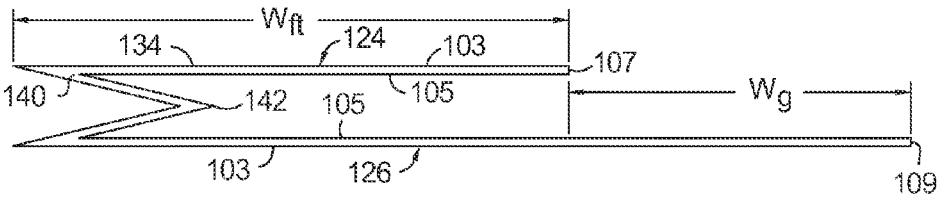
FIG. 6 is a cross-sectional view of a side gusset fold produced during the method of manufacturing the flat bottom pouch shown in FIG. 1, which occurs after the step shown in FIG. 5.
Figure 7:
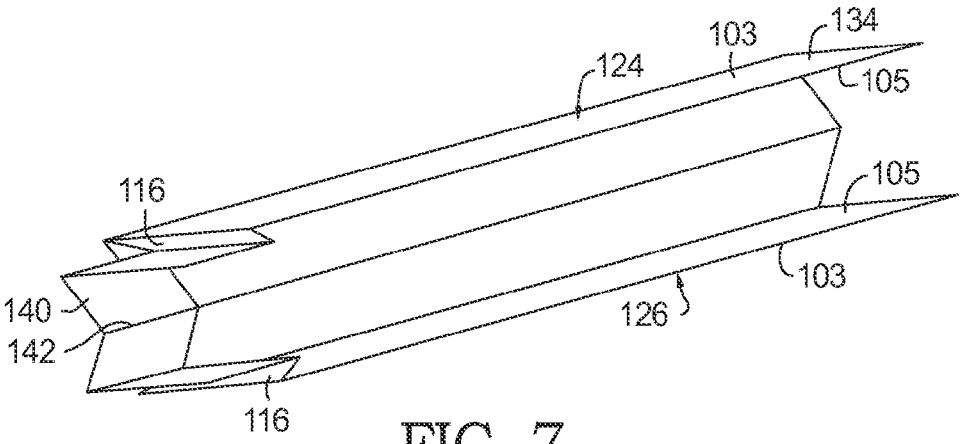
FIG. 7 is a perspective view of the side gusset fold shown in FIG. 6 showing the transverse lap seam produced in the step shown in FIG. 4.

As best seen in FIGS. 1, 5 and 6, folded edge 132 may then engage a gusset former 138, wherein folded edge 132 is pushed between first section 124 and second section 126 so as to form a first gusseted side panel 140 which includes a side gusset fold 142. Further, the portion of first section 124 that was not folded into first gusseted side panel 140 forms a front panel 134 of pouch 101 having a width $W_{fr}$. Alternatively, webbing 104 may be folded into first and second sections 124, 126 and side gusset fold 142 may be added in a single simultaneous operation.

Figure 8:
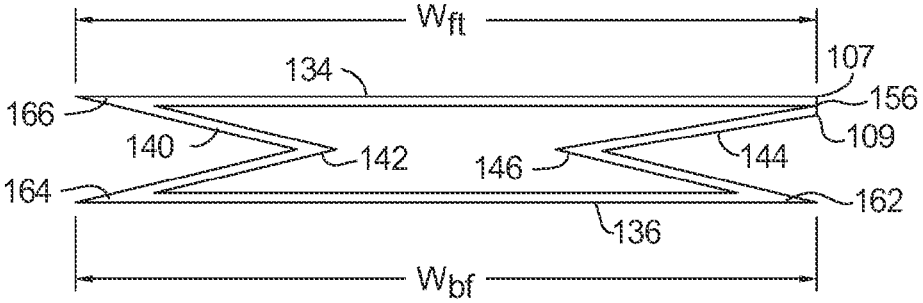
FIG. 8 is a cross-sectional view taken along line 8-8 in FIG. 1 showing webbing opposing side gusset folds produced during the method for manufacturing the flat bottom pouch shown in FIG. 1, which occurs after or simultaneously with the step shown in FIG. 6.

In accordance with an aspect of the present invention, as best seen in FIGS. 6 and 8, a portion $W_g$ of second section 126 may be folded proximate to second distal edge 109, such as to generally form a Z-shaped fold, between first section 124 and second section 126 to thereby form a second gusseted side panel 144 having a side gusset fold 146. Second distal edge 109 may be folded such that second section 126 forms a back panel 136 of pouch 101 having a width $W_m$, which is substantially equal to that of front panel 134 width $W_f$. First gusseted side panel 140 and second gusseted side panel 144 may be formed sequentially with either panel being formed before the other, or these panels 140, 144 may be formed simultaneously.

Figure 11:
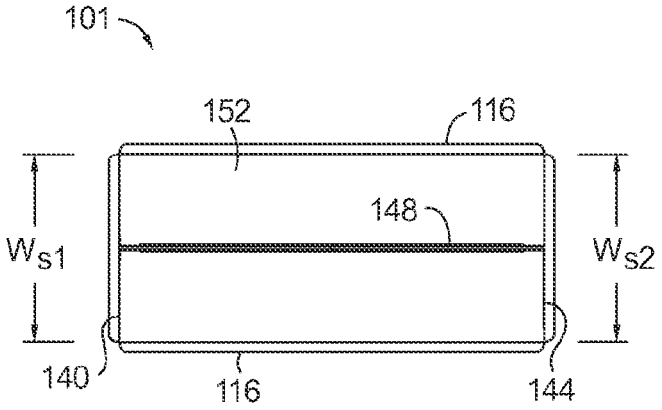
FIG. 11 is a bottom view of the flat bottom pouch shown in FIG. 9.

Webbing 104 may be asymmetrically folded such that the difference $W_g$ between the width $W_f$ of first section 124 and the width $W_b$ of second section 126 is sufficiently large enough such that, when second distal edge 109 is folded as described above, a width $W_{S2}$ of second gusseted side panel 144 at a base of pouch 101 may be substantially equal to a width $W_{S1}$ of first gusseted side panel 140 when pouch 101 is fully opened (see FIG. 11). While pouch 101 is shown in FIG. 11 as having a generally rectangular-shaped base when the pouch is fully open, it should be understood by those skilled in the art that pouches similar to those described herein may be formed to define any desired shape, such as but not limited to, elliptical bases having concave and/or convex front and back panels, trapezoidal-based pouches or any other irregularly shaped base depending upon need or preference. All such alternatives are included within the scope of the present invention.

Figure 9:
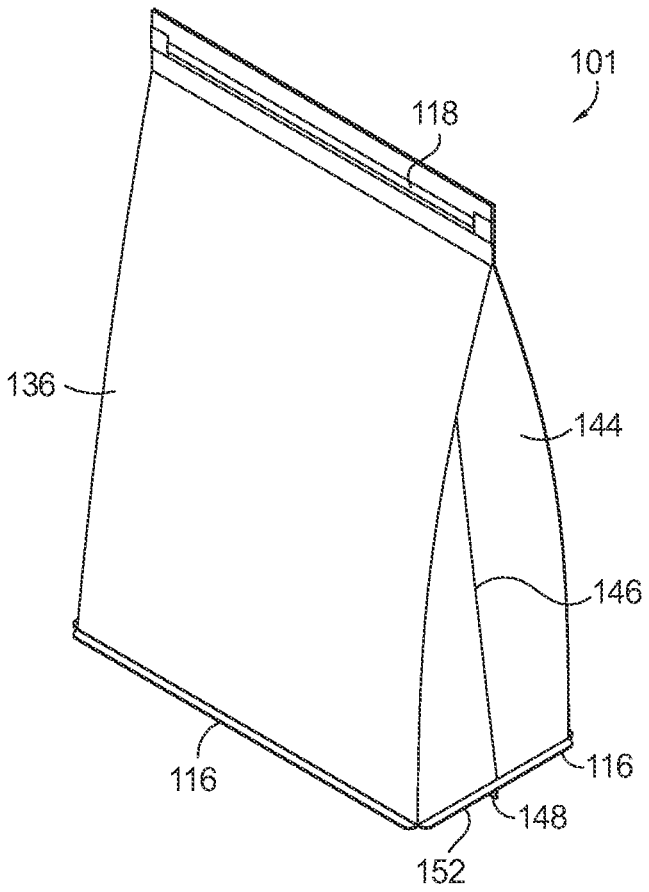
FIG. 9 is a representative view of the flat bottom pouch produced in accordance with the method shown in FIG. 1.
Figure 10:
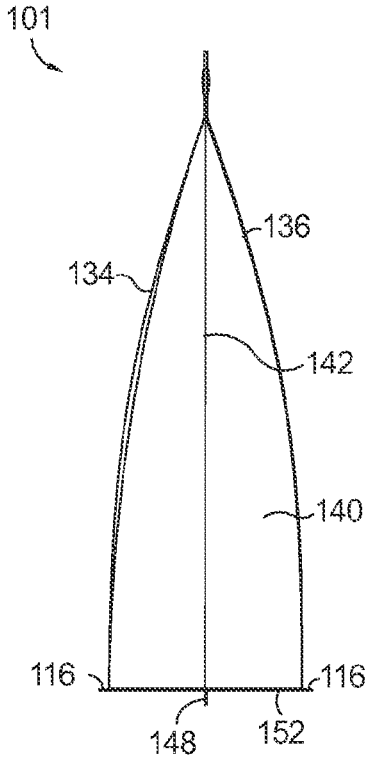
FIG. 10 is a side view of the flat bottom pouch shown in FIG. 9.

Following formation of first and second gusseted side panels 140, 144, a transverse end seal 148 may be formed proximate transverse lap seam 116 by an end seal unit 149, as seen in FIGS. 1-3. Transverse end seal 148 may be a heat seal, although alternative types of seals may be employed and such alternatives are to be considered within the scope of the present invention. Transverse end seal 148 may be spaced apart from lap seam 116 to yield an amount of webbing having a length B. Length B of webbing constitutes a gusseted bottom panel 152 of pouch 101. Length B may be selected so as to be substantially equal to one-half the width $W_g$ (i.e., the width of gusseted side panels 140, 144). In this manner, as shown in FIGS. 9-11, transverse lap seam 116 may be located around the outer periphery of gusseted bottom panel 152 at the intersection between gusseted bottom panel 152 and front and back panels 134, 136 and gusseted side panels 140, 144 when pouch 101 is fully open. Transverse end seal 148 may further operate to form a bottom gusset fold 150 such that, in conjunction with the inherent tendency of the pouch panels 134, 136, 140, 144 to fold at the transverse lap seam 116, gusseted bottom panel 152 may expand sufficiently wide enough to allow full opening of gusseted side panels 140, 144 and create an open pouch with a flat bottom. Transverse end seal 148 may also serve to provide additional structural support to pouch 101 when the pouch is being filled and stored.

As best seen in FIGS. 2, 3 and 6, webbing 104 may also pass through an inline edge sealer 154 wherein first distal edge 107 is affixed to second distal edge 109 at a joined edge 156. In this manner, second gusseted side panel 144 is fixed to front panel 134 so as to form pouch 101 having a contiguous body wall that may be selectively closed with optional resealable closure mechanism 118 (FIG. 9). Opening of resealable closure mechanism 118 permits access to an internal cavity defined by front and back panels 134, 136, gusseted side panels 140, 144, and gusseted bottom panel 152. As best seen in FIG. 8, each of junctions 162, 164, 166 between gusseted side panels 140, 144 and respective front or back panels 134, 136 may also be reinforced by passing through inline edge sealer 154. Sealing of joined edge 156 and junctions 162, 164, 166 may produce a visual and structural bond between the front/rear panels 134, 136 and the gusseted side panels 140, 144. It should be noted that webbing 104 may pass through inline edge sealer 154 either before or after transverse end seal 148 is formed.

After formation of transverse end seal 148 and sealing of joined edge 156 (and additional optional sealing of junctions 162, 164, 166) the single continuous sheet of webbing 104 has been manufactured into flat bottom pouch 101. Flat bottom pouch 101 may then either be cut from the webbing by a pouch cutter 168 (FIG. 3) or may be rewound onto a take-up roll (not shown) so as to form a roll of flat bottom pouches for eventual unwinding and filling. As shown in FIG. 1, for those pouches manufactured without optional resealable closure mechanism 118, pouch 101 may be cut from the webbing proximate the transverse end seal 148 opposite transverse lap seam 116. In this manner, the transverse end seal 148 forms bottom gusset fold 150 of pouch 101 as described above while leaving the top end 170*a* of the next successive pouch 101*a* open. Alternatively, if optional resealable closure mechanism 118 is fabricated into the pouches, the cut is made between the transverse end seal 148 of pouch 101 and the resealable closure mechanism 118*a* of adjacent pouch 101*a*. The cut pouches 101 may then be filled or they may be bundled and palleted for shipment to end users. While shown and described as having top end 170 leading transverse lap seam 116 and transverse end seal 148, it should be understood by those skilled in the art that the pouches may be formed such that transverse lap seam 116 and transverse end seal 148 lead top end 170, 170*a*, wherein the pouch cuts are located so as to yield individual pouches as described above.

Figure 12:
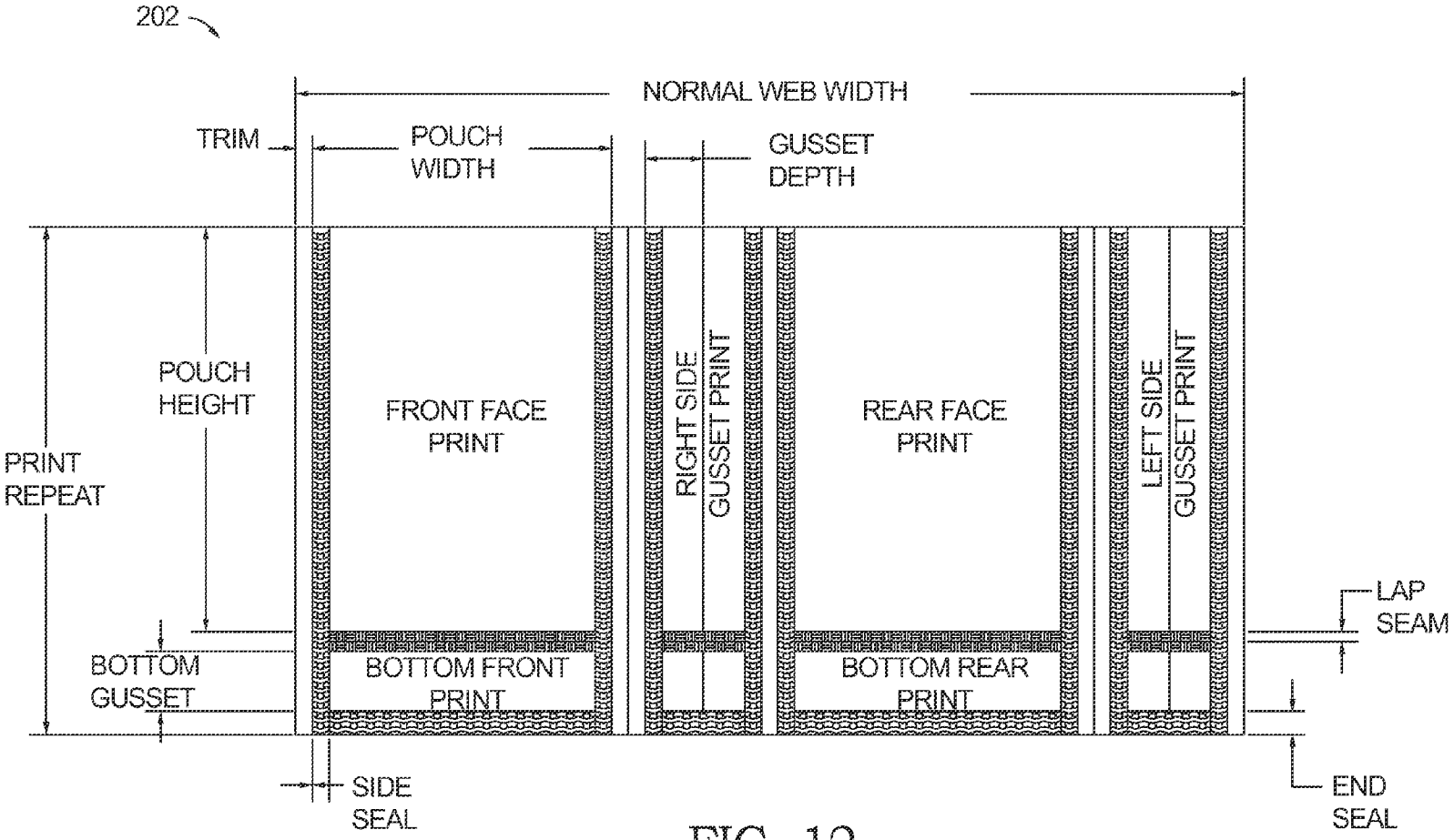
FIG. 12 is schematic view of a print layout that may be used in conjunction with a flat bottom pouch produced in accordance with the method shown in FIG. 1.

Turning now to FIG. 12, because flat bottom pouch 101 is fabricated from a single continuous sheet of webbing, webbing roll 102 may be preprinted with any requested indicia to form a pre-printed webbing sheet 202. The use of a pre-printed webbing sheet 202 simplifies pouch formation using preprinted materials as indexing of the webbing within the pouch forming machines is simplified as only one sheet is being manipulated. In this manner, seams and folds may be more easily and more precisely located and aligned within sheet 202 so that the resultant pouch has minimal, if any, printing errors. Present systems in the art require multiple sheets of webbing to form the various faces of the pouch and thus require careful indexing between and among these numerous sheets to ensure that the completed pouch has properly aligned and oriented printed material. Improper indexing of any one of these sheets of webbings will result in misprinted and therefore, unwanted pouches.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method of manufacturing a flat bottom pouch including a front panel, a back panel, a first gusseted side panel, a second gusseted side panel, and a bottom gusseted panel formed from a single continuous sheet of webbing fed in a first flow direction, the method comprising:

a) unwinding the single continuous sheet of webbing from a roll in a first flow direction, the webbing having a first face forming an outer surface of the pouch, a second face forming an inner surface of the pouch, and opposing first and second distal edges;

b) forming a transverse lap seam in the unwound webbing, wherein the transverse lap seam is oriented transverse to the first flow direction, and wherein the lap seam extends outwardly from the first face;

c) asymmetrically folding the unwound webbing along a longitudinal axis of the webbing to form a folded sheet, the folded sheet defining a first section and a second section having a folded edge therebetween, wherein the first section includes the first distal edge, and wherein the second section includes the second distal edge;

d) pushing the folded edge between the first section and the second section to form the first gusseted side panel having a first side gusset fold;

e) folding a portion of the second section that is proximate to the second distal edge between the first section and the second section to form the second gusseted side panel having a second side gusset fold, wherein the first section defines the front panel, and wherein the second section defines the back panel;

f) forming a transverse end seal proximate the transverse lap seam, wherein the bottom gusseted panel is defined by a length of webbing between the transverse end seal and the transverse lap seam, and wherein the transverse end seal operates to form a bottom gusset fold; and g) sealing the first distal edge to the second distal edge to complete the flat bottom pouch, with the front panel, the back panel, the first gusseted side panel, the second gusseted side panel, and the bottom gusseted panel being formed from the single continuous sheet.

2. The method in accordance with claim 1, wherein steps (d) and (e) are performed sequentially in any order or simultaneously.

3. The method in accordance with claim 1, wherein steps (f) and (g) are performed sequentially in any order.

4. The method in accordance with claim 1, wherein a width of the first side gusseted panel is substantially equal to a width of the second side gusseted panel.

5. The method in accordance with claim 4, wherein the transverse end seal is spaced apart from the transverse lap seam a distance substantially equal to one-half the width of the first side gusseted panel.

6. The method in accordance with claim 1, wherein one, two or all of the steps of forming the transverse lap seam, forming the transverse end seal, and sealing the first distal edge to the second distal edge is conducted using a heat seal.

7. The method in accordance with claim 1, wherein each of steps (a) and (c) through (g) are conducted when the webbing is under tension.

8. The method in accordance with claim 1, further comprising the step of:

h) cutting the flat bottom pouch from the webbing, wherein the cut is proximate the transverse end seal on a side of the transverse end seal that is opposite to the transverse lap seam.

9. The method in accordance with claim 1, further comprising the steps of:

h) winding the pouch onto a roll of flat bottom pouches; and i) repeating steps (a) through (h) to form additional flat bottom pouches on the roll.

10. The method in accordance with claim 1, further comprising the steps of:

h) sealing a junction between the first side gusseted panel and the front panel, a junction between the first side gusseted panel and the back panel, and a junction between the second side gusseted panel, and either the front panel or the back panel and opposite the sealed first and second distal edges.

11. The method in accordance with claim 10, wherein one, two or all of the sealed junctions are formed using a heat seal.

12. The method in accordance with claim 1, further comprising the steps of:

i) affixing a resealable closure mechanism to the webbing by unwinding the resealable closure mechanism from a closure roll in a second flow direction;

ii) sealing the resealable closure mechanism to the second face of the webbing; and iii) cutting the resealable closure mechanism from the closure roll proximate the first or second distal edge after sealing the resealable closure mechanism.

13. The method in accordance with claim 12, wherein the step of affixing the resealable closure mechanism occurs before step (c).

14. The method in accordance with claim 12, wherein the resealable closure mechanism is selected from the group consisting of hook-and-loop mechanism, a zipper mechanism, a slider, and a zip-lock fastener.

15. The method in accordance with claim 12, further comprising the step of:

h) cutting the pouch from the webbing, wherein the cut is between the transverse end seal of the pouch and the resealable closure mechanism of a next successive pouch.

16. The method in accordance with claim 12, further comprising the step of:

h) cutting the pouch from the webbing, wherein the cut is between the resealable closure mechanism of the pouch and the transverse end seal of a next successive pouch.

17. The method in accordance with claim 12, wherein the second flow direction is transverse to the first flow direction.

18. The method in accordance with claim 1, wherein the single continuous sheet of webbing is preprinted with a desired indicia.

19. The method in accordance with claim 18, further comprising the step of indexing the preprinted single continuous sheet of webbing such that the transverse lap seam, the asymmetrical fold, the first side gusseted panel, the second side gusseted panel, and the transverse end seal are properly located and aligned on the flat bottom pouch.

20. The method in accordance with claim 1, wherein the second section has a length that is longer than a length of the first section.

21. The method in accordance with claim 1, wherein in step c), the first distal edge is not aligned with the second distal edge when the unwound webbing is asymmetrically folded.

* * * * *